US009908003B1

(12) United States Patent
Chin

(10) Patent No.: US 9,908,003 B1
(45) Date of Patent: Mar. 6, 2018

(54) DETACHABLE EXERCISE PAD

(71) Applicant: T. K. CHIN COMPANY LTD., Taipei (TW)

(72) Inventor: Howard Chin, Taipei (TW)

(73) Assignee: T.K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 15/282,813

(22) Filed: Sep. 30, 2016

(30) Foreign Application Priority Data

Sep. 5, 2016 (TW) ..... 105128653 A

(51) Int. Cl.

| | |
|---|---|
| ***A63B 24/00*** | (2006.01) |
| ***A63B 26/00*** | (2006.01) |
| ***A63B 21/04*** | (2006.01) |
| ***A63B 21/055*** | (2006.01) |
| ***A63B 21/00*** | (2006.01) |
| ***A63B 23/12*** | (2006.01) |
| *A63B 23/00* | (2006.01) |

(52) U.S. Cl.
CPC ..... *A63B 26/00* (2013.01); *A63B 21/0442* (2013.01); *A63B 21/0557* (2013.01); *A63B 21/4035* (2015.10); *A63B 21/4039* (2015.10); *A63B 23/12* (2013.01); *A63B 2023/006* (2013.01); *A63B 2210/50* (2013.01)

(58) Field of Classification Search
CPC ..... A63B 21/0442; A63B 21/0557; A63B 21/4035; A63B 21/4039; A63B 23/12; A63B 26/00; A63B 2023/006; A63B 2210/50
See application file for complete search history.

(56) References Cited

U.S. PATENT DOCUMENTS

| | | | | |
|---|---|---|---|---|
| 6,461,284 | B1 * | 10/2002 | Francavilla | A61H 1/0218 482/121 |
| 6,730,005 | B1 * | 5/2004 | Liao | A47C 3/16 446/220 |
| D521,084 | S * | 5/2006 | Huang | D21/662 |
| 7,044,558 | B2 * | 5/2006 | Chiu | A47C 4/54 297/217.1 |
| 7,311,644 | B2 * | 12/2007 | Hale | A63B 21/4015 482/132 |
| 8,292,790 | B2 * | 10/2012 | Signorile | A63B 26/003 482/142 |
| 8,328,701 | B2 * | 12/2012 | Dahary | A63B 21/4029 438/258 |

(Continued)

*Primary Examiner* — Glenn Richman
(74) *Attorney, Agent, or Firm* — Lynette Wylie; Apex Juris, pllc.

(57) ABSTRACT

An exercise pad has a base and a pad body. The base is annular and is composed of multiple curved base units. Each base unit has a concave top surface, a bottom surface, an inner edge, two ends, and a curved recess. The ends of the base unit are provided respectively with at least one connection recess and at least one connection post. The curved recess is defined in the bottom surface, and the curved recesses of the multiple base units form an annular recess. The pad body is inflatable, is combined with the base, and has a convex bottom and an annular connection flange. The convex bottom is complementary in shape with the concave top surfaces of the base units. The annular connection flange is formed around a bottom edge of the convex bottom and extends into the annular recess.

12 Claims, 8 Drawing Sheets

(56) References Cited

U.S. PATENT DOCUMENTS

| | | | | |
|---|---|---|---|---|
| 8,678,985 | B2 * | 3/2014 | Mattox | A63B 21/0004 482/142 |
| 9,084,909 | B1 * | 7/2015 | Henley | A63B 21/00047 |
| 2003/0195098 | A1 * | 10/2003 | Hsu | A47C 9/002 482/148 |
| 2005/0143234 | A1 * | 6/2005 | Massey | A63B 21/04 482/140 |

* cited by examiner

DETACHABLE EXERCISE PAD

BACKGROUND OF THE INVENTION

1. Field of the Invention

The present invention relates to an exercise pad, and more particularly to an exercise pad that is easily detached and assembled.

2. Description of Related Art

With reference to FIG. 8, a conventional inflatable exercise pad comprises a base and a pad body. The base is annular and is composed of two annular base elements combined with each other by fasteners. The pad body is inflatable and is mounted securely on the base. The pad body has a bottom edge clamped by the base elements of the base to securely mount the pad body on the base.

However, the base is not capable of being detached or combined freely by a user. Therefore, after manufacture, the exercise pad in whole is packaged and transported, occupying a large space and causing inconvenience.

To overcome the shortcomings, the present invention tends to provide an exercise pad to mitigate or obviate the aforementioned problems.

SUMMARY OF THE INVENTION

The main objective of the invention is to provide an exercise pad that is detachable and is convenient in use.

The exercise pad has a base and a pad body. The base is annular and is composed of multiple curved base units connected with each other. Each base unit has a concave top surface, a bottom surface, an inner edge, two ends, and a curved recess. The ends of the base unit are provided respectively with at least one connection recess and at least one connection post. The curved recess is defined in the bottom surface and extends to the inner edge of the base unit, and the curved recesses of the multiple base units form an annular recess in a bottom of the base. The pad body is inflatable, is combined with the base, and has a convex bottom and an annular connection flange. The convex bottom is complementary in shape with the concave top surfaces of the base units. The annular connection flange is formed around a bottom edge of the convex bottom and extends into and is held in the annular recess in the base.

Other objects, advantages and novel features of the invention will become more apparent from the following detailed description when taken in conjunction with the accompanying drawings.

DETAILED DESCRIPTION OF PREFERRED EMBODIMENT

Figure 1:
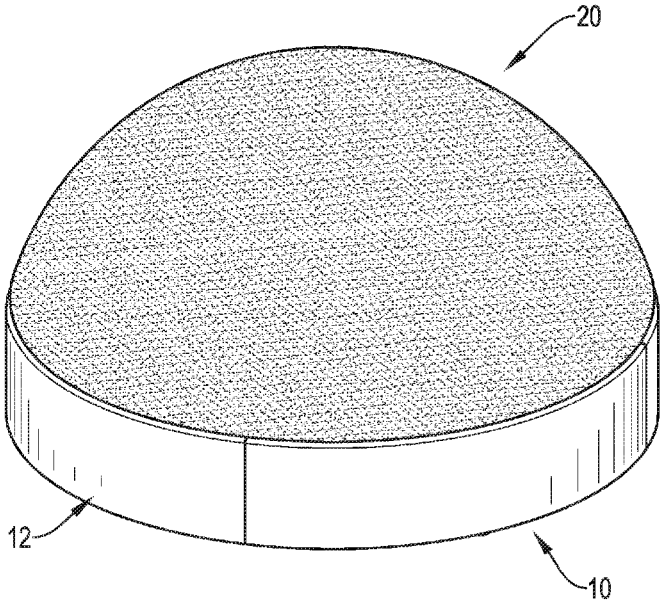
FIG. 1 is a perspective view of a first embodiment of an exercise pad in accordance with the present invention.
Figure 2:
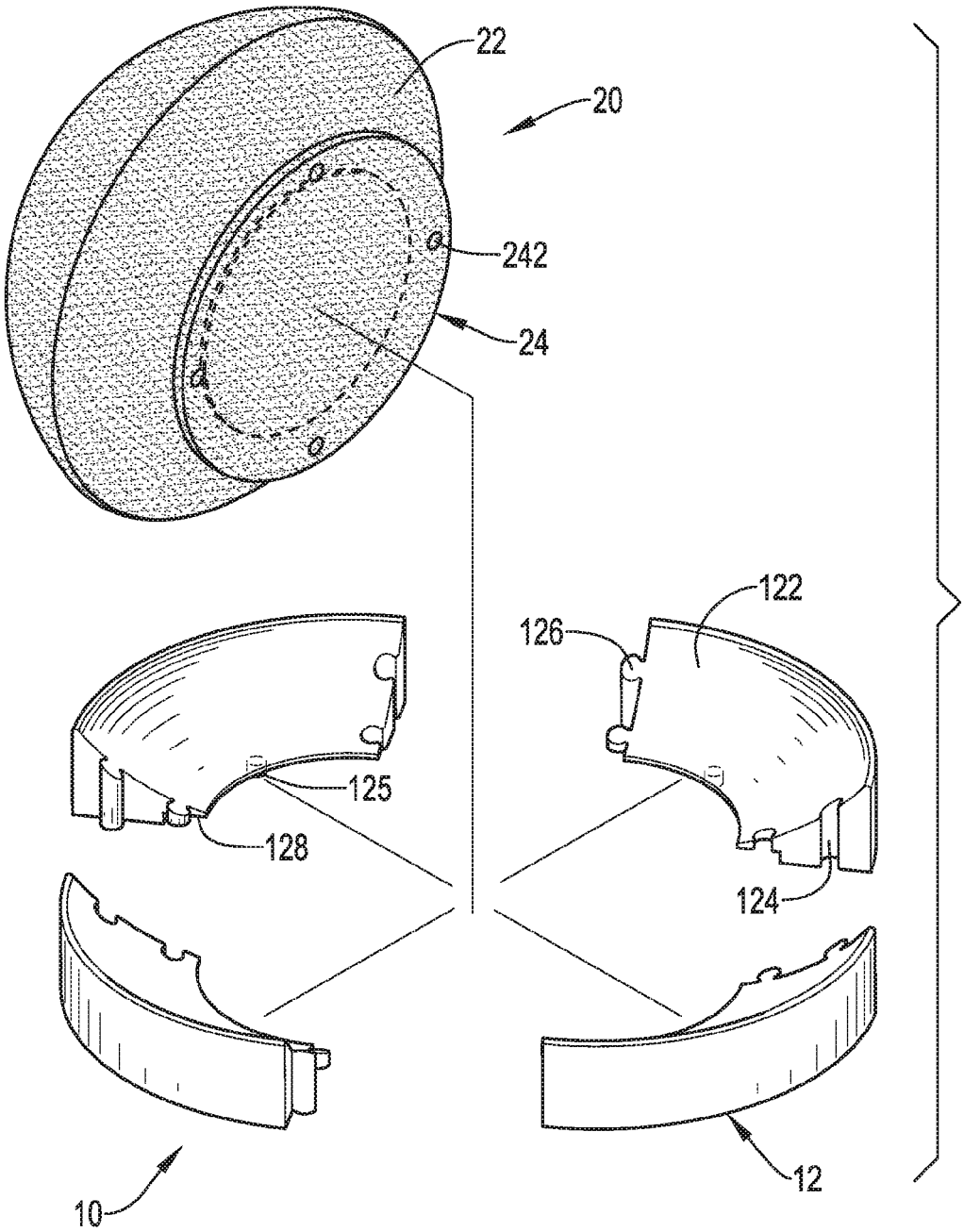
FIG. 2 is an exploded perspective view of the exercise pad in FIG. 1.
Figure 3:
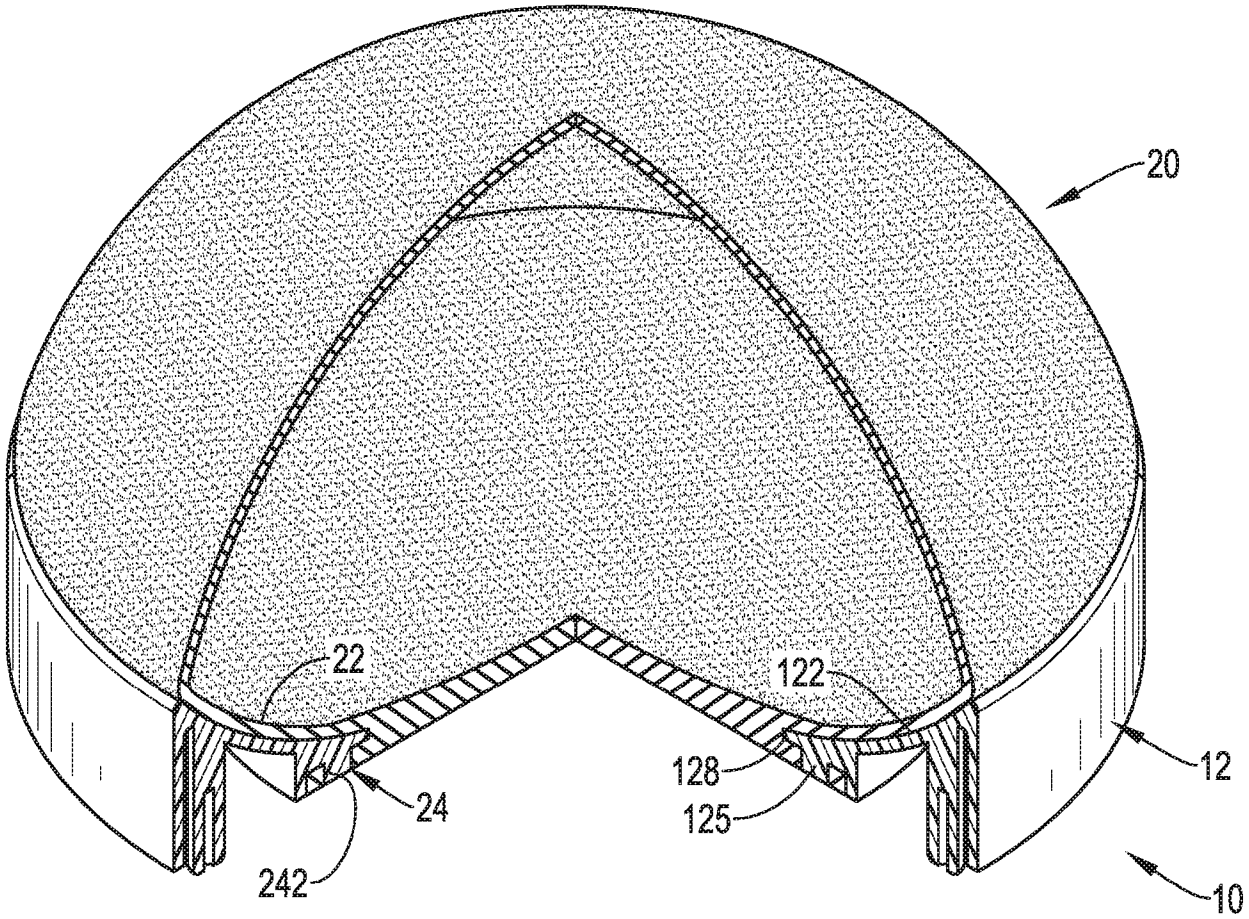
FIG. 3 is a perspective view in partial section of the exercise pad in FIG. 1.
Figure 4:
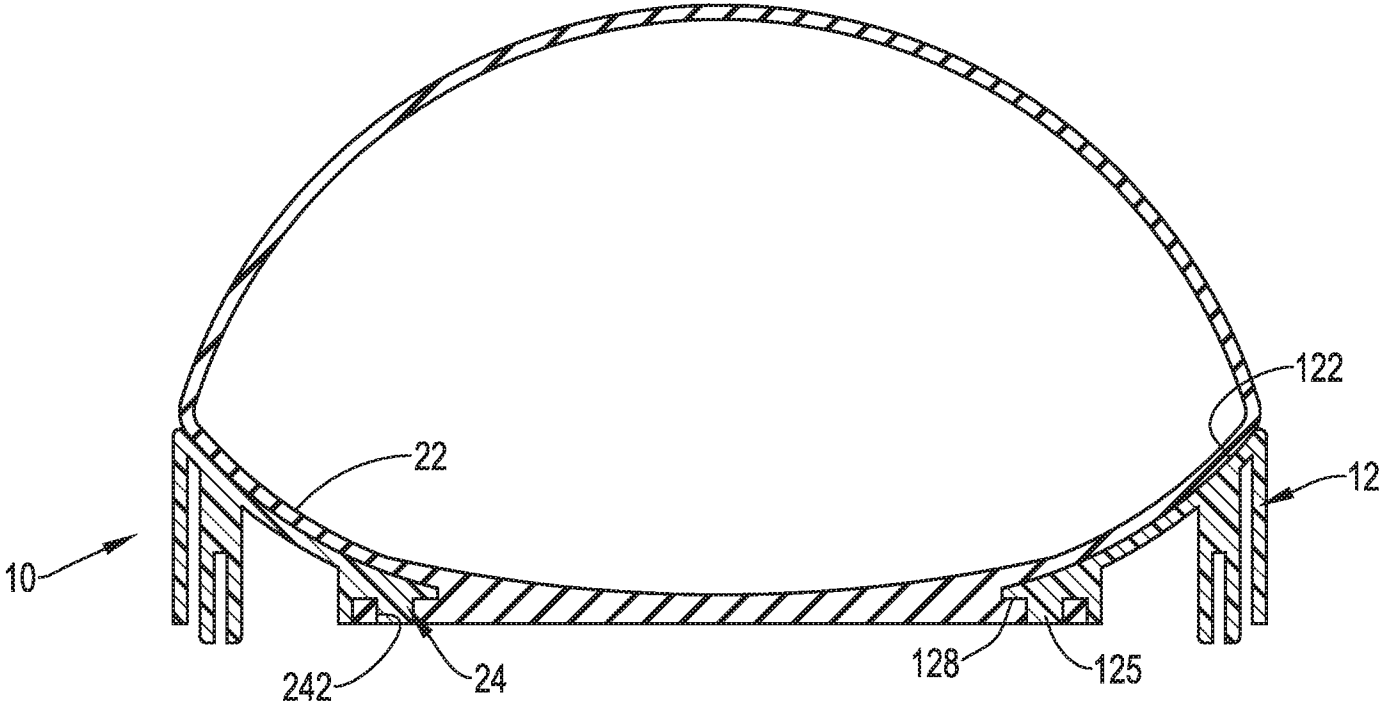
FIG. 4 is a cross sectional side view of the exercise pad in FIG. 1.

With reference to FIGS. 1 to 4, an exercise pad in accordance with the present invention comprises a base 10 and a pad body 20. The base 10 is annular and is composed of multiple base units 12. Preferably, the base 10 is composed of four base units 12. Each base unit 12 is curved and has a concave top surface 122, a bottom surface, an inner edge, two ends, a curved recess 128, and at least one positioning post 125. The ends of each base unit are provided respectively with at least one connection recess 124 and at least one connection post 126. The at least one connection post 126 of each base unit 12 is inserted respectively into the at least one connection recess 124 in the adjacent base unit 12. Accordingly, the base units 12 are combined with each other to form the annular base 10. The curved recess 128 is defined in the bottom surface and extends to the inner edge of the base unit 12, and the curved recesses 128 of the multiple base units 12 form an annular recess in a bottom of the base 10. The at least one positioning post 125 is formed on and protrudes from the bottom surface of the base unit 12. In the first embodiment, the at least one positioning post 125 is formed on an inner surface of the curved recess 128 in the base unit 12.

The pad body 20 is inflatable, is combined with the base 10, and has a convex bottom 22, an annular connection flange 24, and multiple positioning holes 242. Preferably, a nozzle is mounted on the pad body 20 for a user to inflate the pad body 20. In the first embodiment, the pad body 20 may be semispherical or spherical in shape. The convex bottom 22 is complementary in shape with the concave top surfaces 122 of the base units 12. The annular connection flange 24 is formed around a bottom edge of the convex bottom 22 and extends into and is held in the annular recess in the base 10. With the annular connection flange 24 extending into the annular recess in the bottom of the base 10, the pad body 20 can be securely held in and combined with the base 10. The positioning holes 242 are defined through the connection flange 24. The at least one positioning post 125 on each base unit 12 extends respectively into at least one of the multiple positioning holes 242 in the pad body 20. With the positioning posts 125 extending into the positioning holes 242, the combination between the pad body 20 and the base 10 is enhanced.

With such an arrangement, a user can sit on the pad body 20 to stretch or expand his/her body for exercising. Because the base 10 is composed of multiple base units 12, the base 10 can be disassembled into multiple base units 12 for packaging or transport. At this time, the pad body 20 can be inherently detached from the base 10. Therefore, the space for transporting or storing the exercise pad can be effectively reduced. In addition, to detach or to combine the base 10 with the pad body 20 does not need any tool and can be done manually by a user, so the exercise pad is convenient in use.

Figure 5:
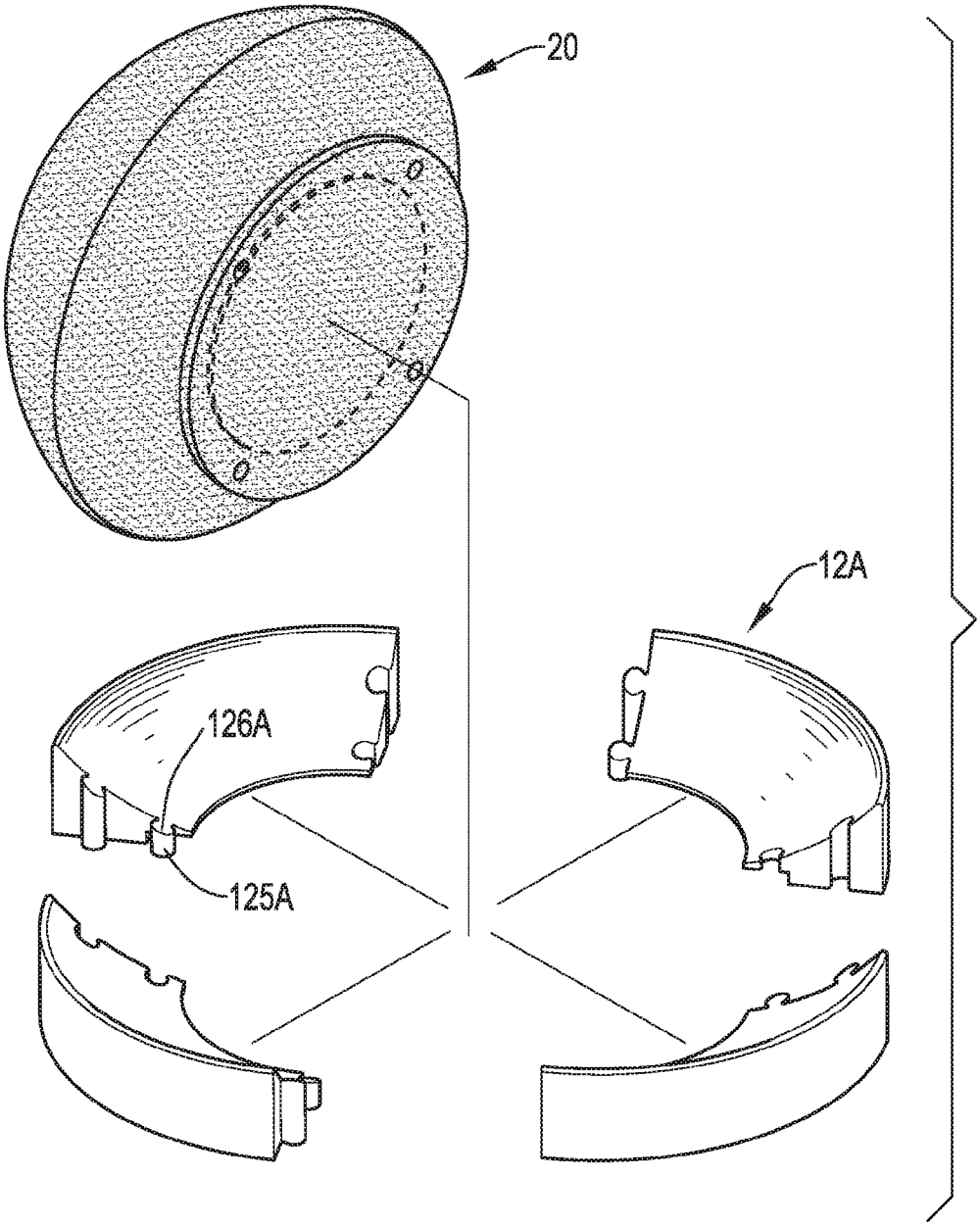
FIG. 5 is an exploded perspective view of a second embodiment of an exercise pad in accordance with the present invention.

With reference to FIG. 5, in the second embodiment, the at least one positioning post 125A in each base unit 12A is implemented as one in amount and is formed on and extends from one of the at least one connection post 126A on the base unit 12A. Accordingly, the structure of the base unit 12A can be simplified, and the manufacturing cost for the exercise pad can be reduced.

Figure 6:
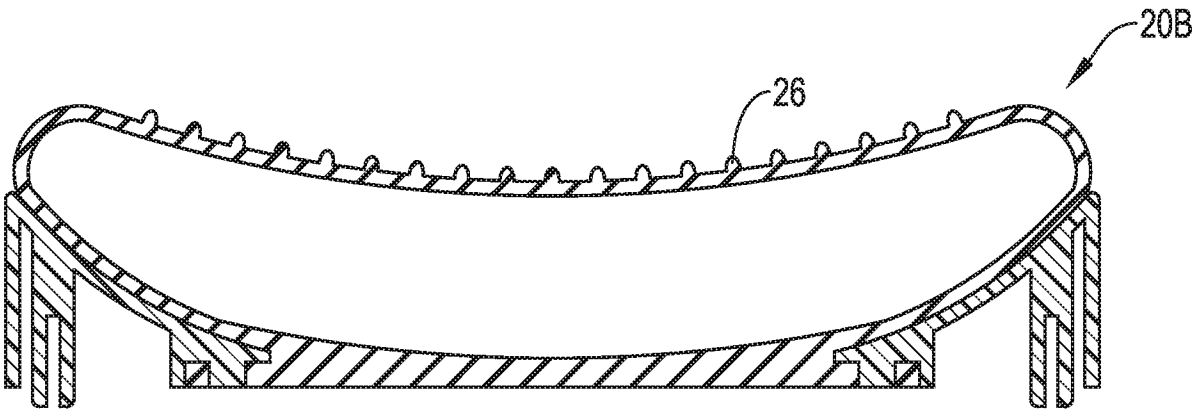
FIG. 6 is a cross sectional side view of a third embodiment of an exercise pad in accordance with the present invention.

With reference to FIG. 6, in the third embodiment, the pad body 20B has a concave top and multiple protuberances 26 formed on and protruding from the concave top. Therefore, the user can sit in the concave top of the pad body 20B, and the protuberances 26 can provide a massaging effect to the user.

Figure 7:
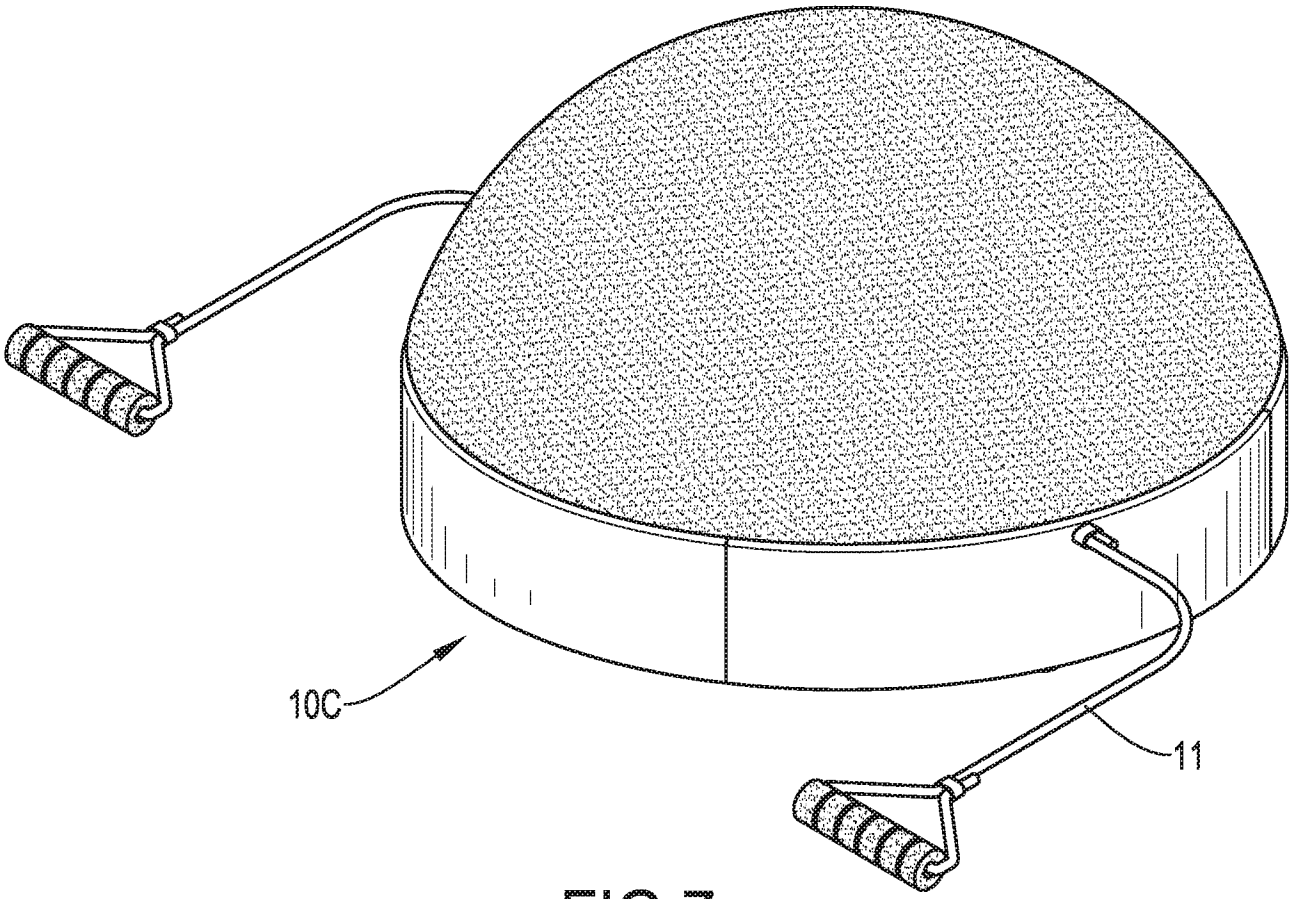
FIG. 7 is a perspective view of a fourth embodiment of an exercise pad in accordance with the present invention.
Figure 8:
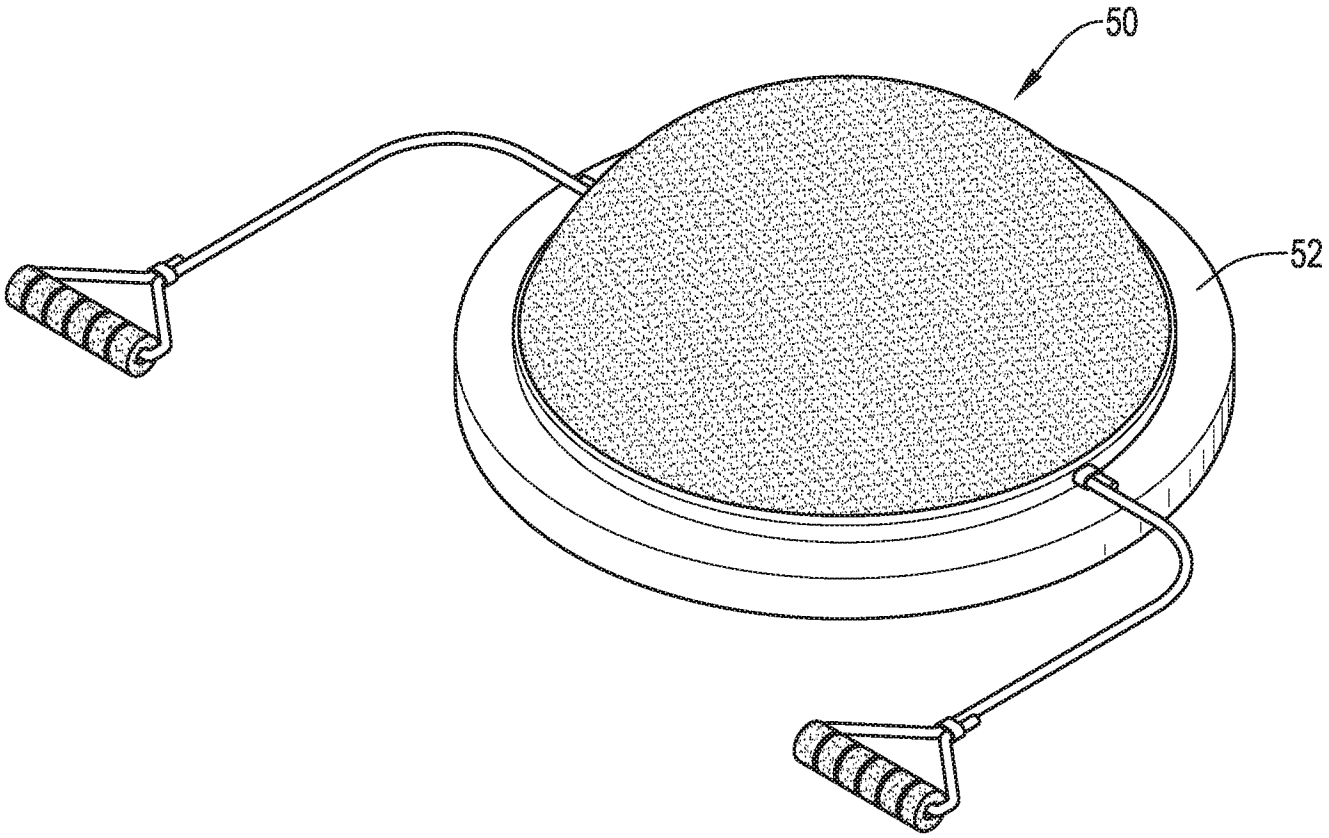
FIG.8 PRIOR ART
FIG. 8 is a perspective view of a conventional exercise pad.

With reference to FIG. 7, in the fourth embodiment, the base 10C further has two resilient ropes 11 connected with the base 10C and being diametrically opposite each other. Accordingly, while the user sits on the pad body 20, the user can pull and extend the resilient ropes 11 with two hands for difference exercises, such that the exercise pad in accordance with the present invention is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise pad comprising:

a base being annular and composed of multiple curved base units connected with each other; and each base unit having a concave top surface;

a bottom surface;

an inner edge;

two ends provided respectively with at least one connection recess and at least one connection post; and a curved recess defined in the bottom surface and extending to the inner edge of the base unit, wherein the curved recesses of the multiple base units form an annular recess in a bottom of the base; and a pad body being inflatable, combined with the base, and having a convex bottom complementary in shape with the concave top surfaces of the base units; and an annular connection flange formed around a bottom edge of the convex bottom and extending into and held in the annular recess in the base, wherein the pad body further has multiple positioning holes defined through the connection flange; and each base unit has at least one positioning post formed on and protruding from the bottom surface of the base unit and extending respectively into at least one of the multiple positioning holes in the pad body.

2. The exercise pad as claimed in claim 1, wherein the at least one positioning post on each base unit is formed on an inner surface of the curved recess in the base unit.

3. The exercise pad as claimed in claim 2, wherein the pad body is semispherical in shape.

4. The exercise pad as claimed in claim 3, wherein the base further has two resilient ropes connected with the base and being diametrically opposite each other.

5. The exercise pad as claimed in claim 2, wherein the pad body has a concave top and multiple protuberances formed on and protruding from the concave top.

6. The exercise pad as claimed in claim 5, wherein the base further has two resilient ropes connected with the base and being diametrically opposite each other.

7. The exercise pad as claimed in claim 1, wherein the at least one positioning post in each base unit is implemented as one in amount and is formed on and extends from one of the at least one connection post on the base unit.

8. The exercise pad as claimed in claim 7, wherein the pad body is semispherical in shape.

9. The exercise pad as claimed in claim 8, wherein the base further has two resilient ropes connected with the base and being diametrically opposite each other.

10. The exercise pad as claimed in claim 7, wherein the pad body has a concave top and multiple protuberances formed on and protruding from the concave top.

11. The exercise pad as claimed in claim 10, wherein the base further has two resilient ropes connected with the base and being diametrically opposite each other.

12. The exercise pad as claimed in claim 10, wherein the base further has two resilient ropes connected with the base and being diametrically opposite each other.

* * * * *